US008025458B2

(12) United States Patent
Musil et al.

(10) Patent No.: US 8,025,458 B2
(45) Date of Patent: Sep. 27, 2011

(54) FRAME RAISING MULTI-USE PAVING TRACTOR WITH BLIND MATEABLE QUICK CONNECTING TOOL ATTACHMENTS

(75) Inventors: Joseph E. Musil, Ely, IA (US); Vince Egan, Norwood, CO (US)

(73) Assignee: Terex USA, LLC, Wilmington, DE (US)

( * ) Notice: Subject to any disclaimer, the term of this patent is extended or adjusted under 35 U.S.C. 154(b) by 0 days.

(21) Appl. No.: 13/074,614

(22) Filed: Mar. 29, 2011

(65) Prior Publication Data

US 2011/0176868 A1 Jul. 21, 2011

Related U.S. Application Data

(63) Continuation of application No. 12/268,741, filed on Nov. 11, 2008, now Pat. No. 7,938,596, which is a continuation of application No. 11/382,441, filed on May 9, 2006, now Pat. No. 7,458,747, which is a continuation of application No. 10/605,249, filed on Sep. 17, 2003, now abandoned.

(60) Provisional application No. 60/596,468, filed on Sep. 26, 2005.

(51) Int. Cl.
*E01C 19/12* (2006.01)

(52) U.S. Cl. ..... 404/86; 404/72; 404/83; 404/85

(58) Field of Classification Search ..... 404/72, 404/83, 85, 86
See application file for complete search history.

(56) References Cited

U.S. PATENT DOCUMENTS

| | | | | |
|---|---|---|---|---|
| 3,901,616 | A * | 8/1975 | Greening | 404/102 |
| 6,481,925 | B1 * | 11/2002 | Olson | 404/108 |
| 6,543,962 | B2 * | 4/2003 | Wells | 404/118 |
| 6,582,152 | B2 * | 6/2003 | Leone et al. | 404/75 |
| 7,458,748 | B2 * | 12/2008 | Guntert et al. | 404/118 |

* cited by examiner

*Primary Examiner* — Raymond Addie
(74) *Attorney, Agent, or Firm* — Simmons Perrine Moyer Bergman PLC

(57) ABSTRACT

A multi-use asphalt paving tractor with frame raise capability and a blind-mateable connector to facilitate quick connection with interchangeable attachments for performing the functions of a paver, a mix transfer conveyor and road widener.

5 Claims, 7 Drawing Sheets

FRAME RAISING MULTI-USE PAVING TRACTOR WITH BLIND MATEABLE QUICK CONNECTING TOOL ATTACHMENTS

FIELD OF THE INVENTION

The present invention generally relates to road paving equipment, and more particularly relates to pavers, and even more particularly relates to pavers with a capability for remixing hot mix asphalt (HMA) material placed in the hopper onboard the paver.

BACKGROUND OF THE INVENTION

In the past, road paving equipment designers have endeavored to improve the functionality of road pavers. U.S. Pat. No. 6,007,272 is an example of an improved paver with mixing capabilities. While such improvements have been made to remixing capabilities of pavers, they remain a single use machine. Most paving contractors will have a paver, a road widener and some means for transferring the mix to the paver and road widener, all of which are independent machines.

While these approaches of using independent pavers, road wideners and mix transfer machines, etc. have been used extensively in the past, they do have some drawbacks. First of all, they require significant investment. Secondly, they require considerable space for storage and transportation.

Consequently, there exists a need for improved methods and systems for deploying multiple paving equipment tools.

SUMMARY OF THE INVENTION

It is an object of the present invention to provide a system and method for deploying multiple paving equipment tools in an efficient manner.

It is a feature of the present invention to utilize a blind-mateable multi-use paving tractor.

It is an advantage of the present invention to reduce the cost of deploying a group of paving tools.

It is another advantage to permit multiple paving equipment tools to be easily coupled to a multi-use paving tractor.

It is yet another advantage to permit reduced costs in coupling several paving tools to a multi-use paving tractor on a job site.

The present invention is an apparatus and method for deploying multiple paving tools, designed to satisfy the aforementioned needs, provide the previously stated objects, include the above-listed features, and achieve the already articulated advantages. The present invention is carried out in a "wasted time-less" manner in a sense that the time needed to couple and uncouple multiple paving hoppers, remixing equipment and propulsion mechanisms for a group of road paving tools, has been greatly reduced.

Accordingly, the present invention is a system and method including a paving tractor with a capability for readily connecting and disconnecting a road paving tool thereto.

BRIEF DESCRIPTION OF THE DRAWINGS

The invention may be more fully understood by reading the following description of the preferred embodiments of the invention, in conjunction with the appended drawings wherein:

FIG. 7 is a side view of a detached HMA transfer tool attachment with a blind-mateable connection to a multi-use paving tractor.

DETAILED DESCRIPTION

Figure 1:
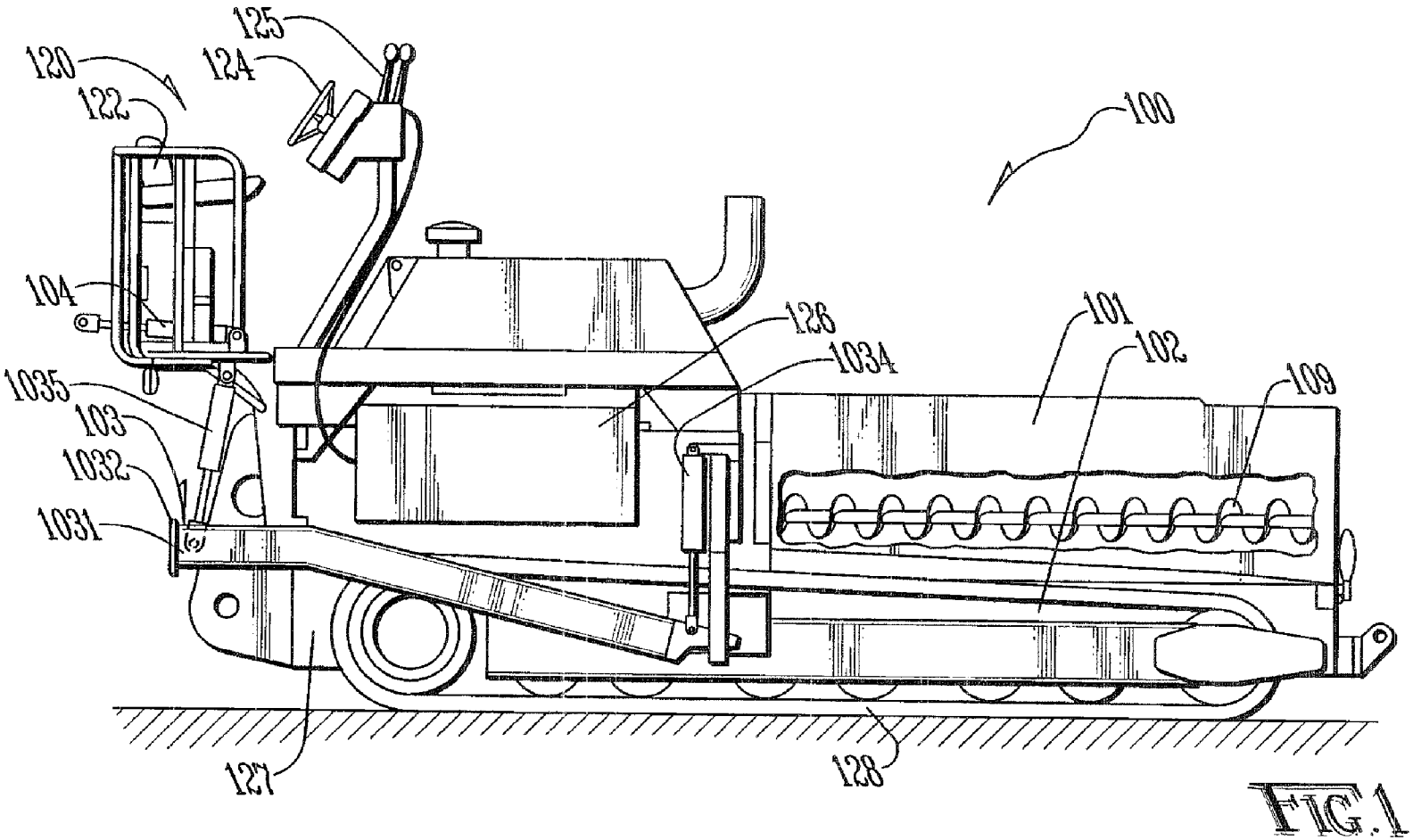
FIG. 1 is an elevation view of the multi-use paving tractor of the present invention, with a partial cut-away portion to reveal a plurality of remixing augers.

Now referring to the drawings wherein like numerals refer to like matter throughout, and more specifically referring to FIG. 1, there is shown a multi-use paving tractor of the present invention, generally designated 100, which includes a hopper and mixing apparatus 101, a conveying shaft 102, auger 109, driver station 120, driver seat 122, steering wheel 124, engine 126, chassis 127 and drive train 128. Items 101, 102, 109, 122, 124, 126, 127 and 128 are preferably similar or identical to components of prior art remixing road pavers such as described in the above-referenced U.S. patent and the prior art road paver manufactured by Cedarapids, Inc. of Cedar Rapids, Iowa. Engine 126 is drawn as a simple block, but it may include numerous related systems and/or components not limited to components of a hydraulic pump and system, an electrical system and other systems. One of the key aspects of these prior art pavers is that they do not exhibit the characteristics of dropping or dribbling asphalt from a return conveyor under the machine as is common in other prior art pavers. The elimination of dribbling from underneath the prior art paver was not perceived as a significant benefit because that machine and the machine described in the above-referenced patent were both dedicated pavers. Dribbles on the ground in front of a paver were not a problem because the paver covered these dribbles as the paver progressed forward. However, for the present invention, it is desirable that the tractor 100 not dribble asphalt on the ground as it progresses forward. The non-dribbling configuration of the above-referenced patent and the above-described paver is preferred. However, it should be understood that any other non-dribbling or low-dribbling mechanisms could be used in conjunction with the remainder of the present invention.

A pull arm 103 is shown coupled to the tractor 100. Preferably, a pull arm 103 is disposed on each side of the tractor. Pull arm 103 may include a quick connector 1032 disposed on or near a rear end 1031 of the pull arm 103. Pull-arm quick connector 1032 could be numerous types of connectors, such as a butt plate with holes for receiving bolts or pins, a channel for receiving an insert dropped in from above, a male or female connector, etc. Pull arm quick connector 1032 may have additional connectivity capability beyond structural connections, such as electric connections, hydraulic hose connections, etc. In any case, it is preferred that pull arm quick connector 1032 provide for the ability to add or remove attachments very quickly and while in the field. Preferably, no welding or powered tools, other than those receiving power from the multi-use paving tractor 100 and a lift used to move the attachment, would be necessary. Hydraulic cylinders 1034 and 1035 or other mechanism for manipulating pull arm 103 between various raised and lowered positions are also shown. In a preferred arrangement, the pull arm 103 can be raised or lowered to engage tool attachments, discussed in detail below. While it may be preferred to utilize dual pull arms 103 on each side, it should be understood that a centrally disposed pull arm or group of centrally disposed pull arms could be used as well. The pull arm 103 is preferably movable, but it should be understood that it could be a simple fixed connection point disposed on the tractor 100. An upper link 104 could be another connection between the tractor 100 and tool attachments. Upper link 104, if hydraulically extendable and retractable, could be used to connect, position and otherwise manipulate any tool attachment coupled to pull arm 103. (Note that the upper link 104 may not be used on some attachments, such as the screed.) An upper link 104 may be disposed on either side of the tractor 100, or a single upper link could be used as well. Appropriate driver controls 125 may be included to assist in the manipulation of pull arm 103 and upper link 104.

Figure 2:
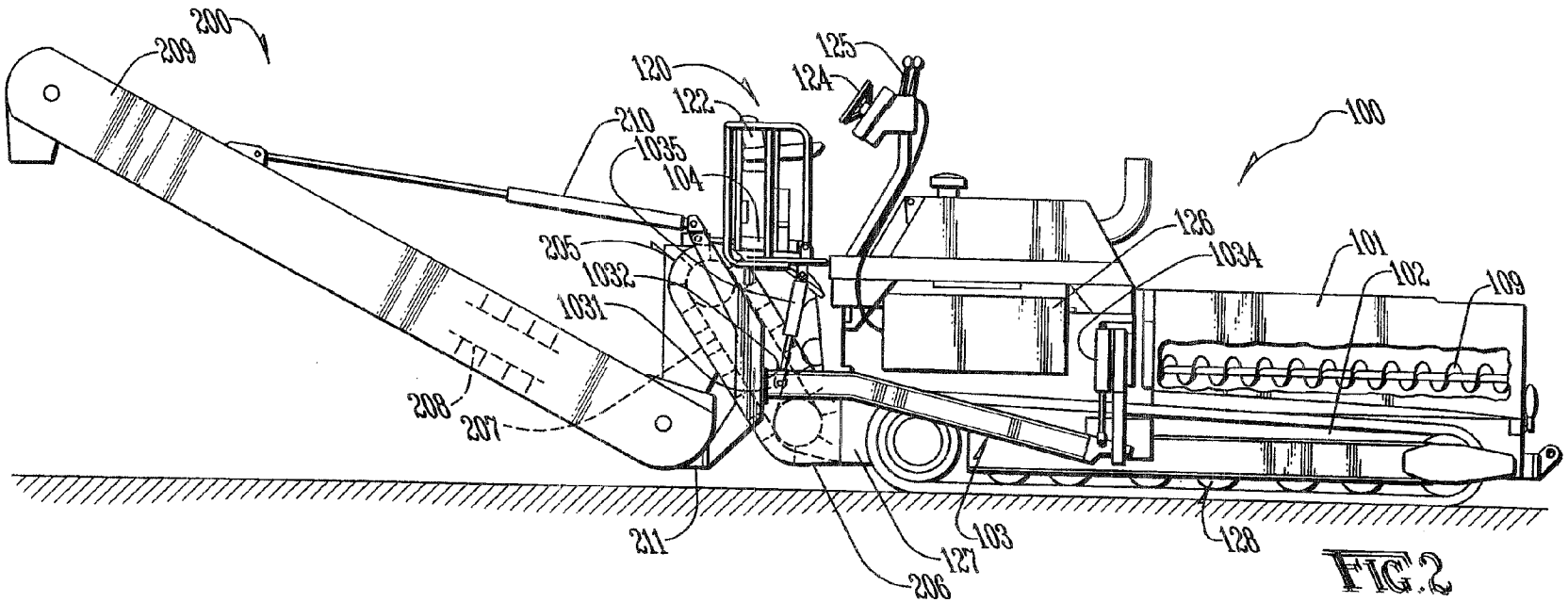
FIG. 2 is an elevation view of the paving tractor of FIG. 1, having an attached mix transfer tool.

A more detailed understanding of the present invention can be achieved by now referring to FIG. 2, which shows a multi-use paving tractor 100 of FIG. 1, together with an HMA mix transfer tool attachment, generally designated 200, which includes an elevator assembly 205, which collects remixed HMA from the rear of conveying shaft 102 and hopper and mixing apparatus 101 and elevates the HMA. Elevator assembly 205 includes elevator assembly lower connecting floor 206, which seals the elevator assembly 205 to the rear of the conveying shaft 102. Elevator assembly lower connecting floor 206 is where the HMA is collected prior to being elevated above the conveying shaft 102 by the elevator assembly 205. Elevator assembly slat conveyor 207 is shown disposed in elevator assembly 205. It should be understood that the depicted arrangement of elevator assembly 205 is a preferred embodiment of the present invention. Alternate means and methods of elevating the HMA could be employed, such as augers, pumps and pipes or hoses, etc. The purpose of elevator assembly 205 is to collect the HMA and deliver it to swinging slat conveyor 209. However, it should be understood that elevator assembly 205 or its alternate means could be adjustable vertically and radially so as to eliminate the need for swinging slat conveyor 209.

In this preferred embodiment, swinging slat conveyor 209 is a vertically and radially adjustable conveyor which can be swung to the right or the left upon swinging slat conveyor pivot support 211, which can be a hinge or other pivot support. Swinging slat conveyor 209 includes a swinging slat conveyor interior chain assembly 208 and a swinging slat conveyor raising mechanism 210 which can be disposed on one pull arm 103 or one side of the multi-use paving tractor 100, or it can have one on each side of multi-use paving tractor 100 or attached to right and left pull arms 103. Swinging slat conveyor raising mechanism 210, if mounted to a side of multi-use paving tractor 100, can both raise swinging slat conveyor 209 and swing swinging slat conveyor 209 right and left as needed. Swinging slat conveyor raising mechanism 210 can be a hydraulic cylinder, a cable/winch system or other system for lifting and swinging the swinging slat conveyor 209.

Swinging slat conveyor pivot support 211 is preferably a support for pivoting about a horizontal axis and a vertical axis. A rotational coupling or independent orthogonal pivots could be used to enable swinging slat conveyor 209 to be both raised and swung as needed.

Figure 3:
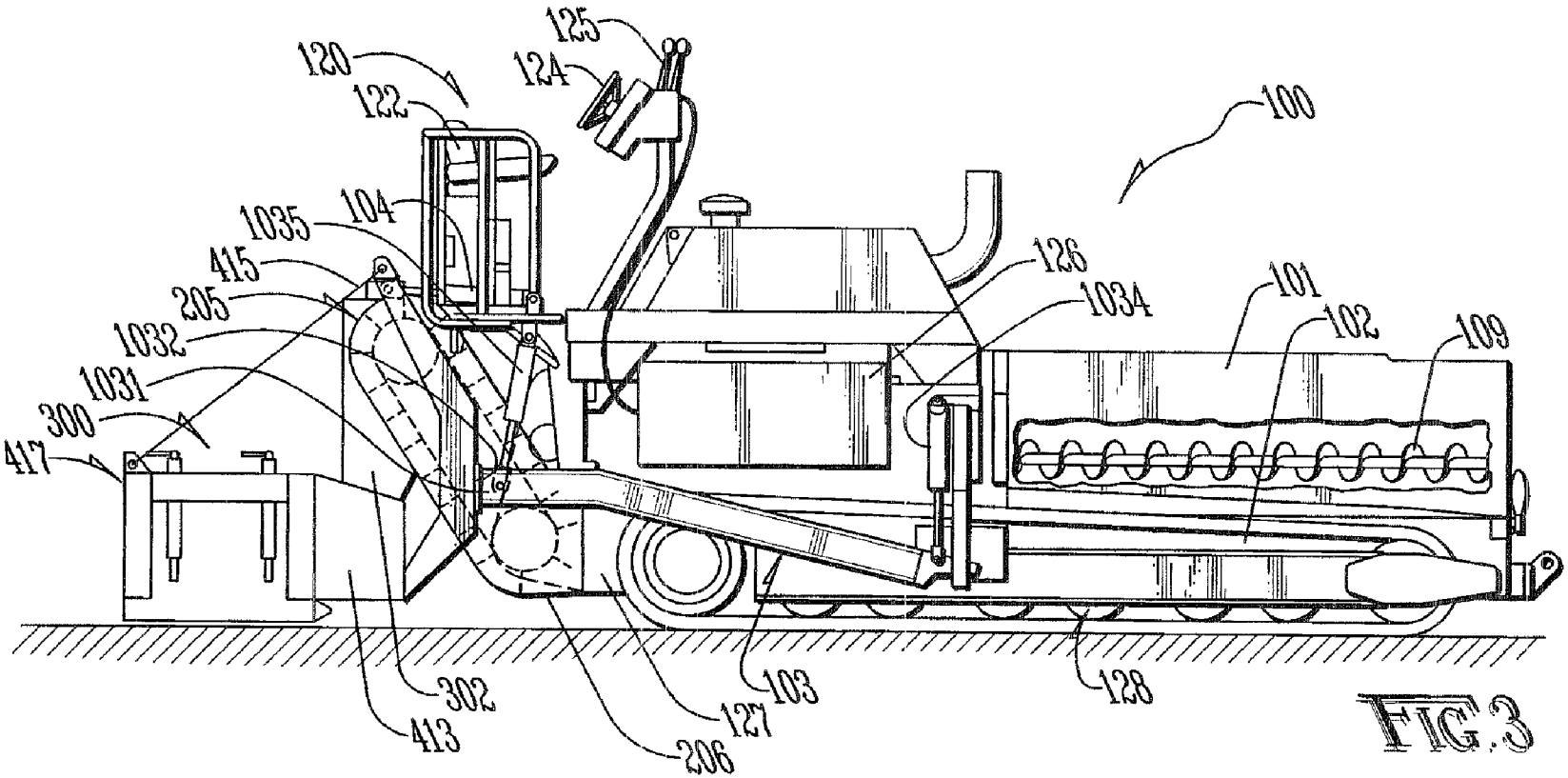
FIG. 3 is an elevation view of the paving tractor of FIG. 1, having an attached road widener tool.
Figure 4:
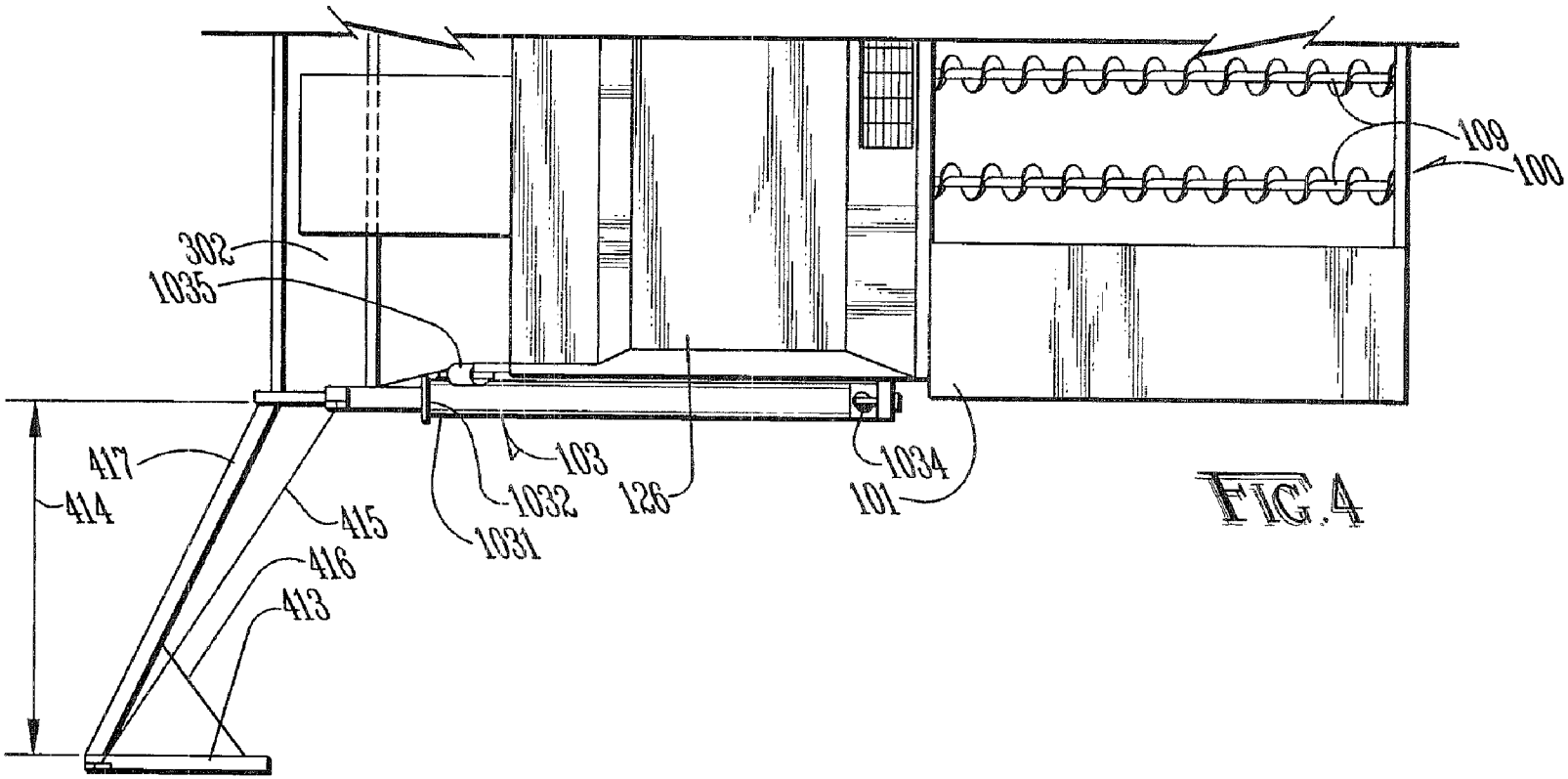
FIG. 4 is a partial top view of the paving tractor and road widener tool of FIG. 3.

An even more detailed understanding of the present invention may be achieved by now referring to FIGS. 3 and 4, which shows a right- or left-sided road widener attachment 300, which is preferably attached to multi-use paving tractor 100 via pull arm 103. In this figure, elevator assembly 205 is used to elevate the HMA for distribution to a chute or cross conveyor 302. The HMA is then distributed alongside the multi-use paving tractor 100 so as to provide for road widening by road widener strike-off blade 417. The road width extension dimension 414 can be adjusted by manipulation of road widener strike-off blade angle control link 415, which controls the angle of road widener strike-off blade 417. The HMA is partially contained by road widener end gate assembly 413, which is adjusted by manipulation of road widener end gate angle control link 416. Right- or left-sided road widener attachment 300 is shown with few details because it is believed that numerous right- or left-sided road widener attachments 300 could be designed to meet the peculiar needs for various road types. It is believed that a person skilled in the art of making road wideners could readily adapt the above-described concept to work with most any particular road widening project type. For example, road widener strike-off blade 417 could be made to pivot about both a horizontal axis and a vertical axis.

Figure 5:
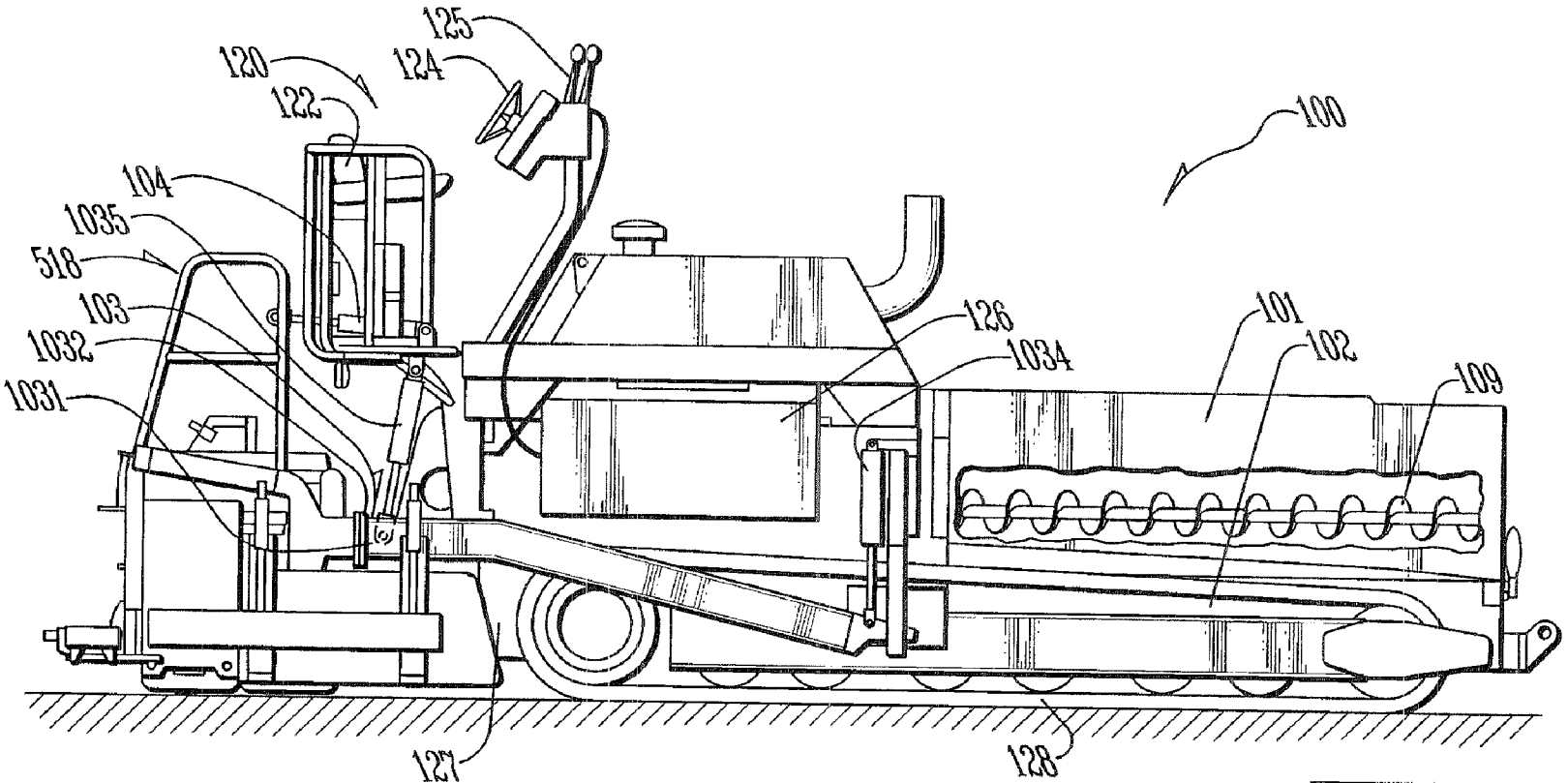
FIG. 5 is an elevation view of the paving tractor of FIG. 1, having an attached screed.

FIG. 5 shows a multi-use paving tractor 100 with a paver screed 518 attached thereto. It is believed that one skilled in the art given the description of the present invention could develop various paver screeds 518 to meet particular needs of various paving job types.

Figure 6:
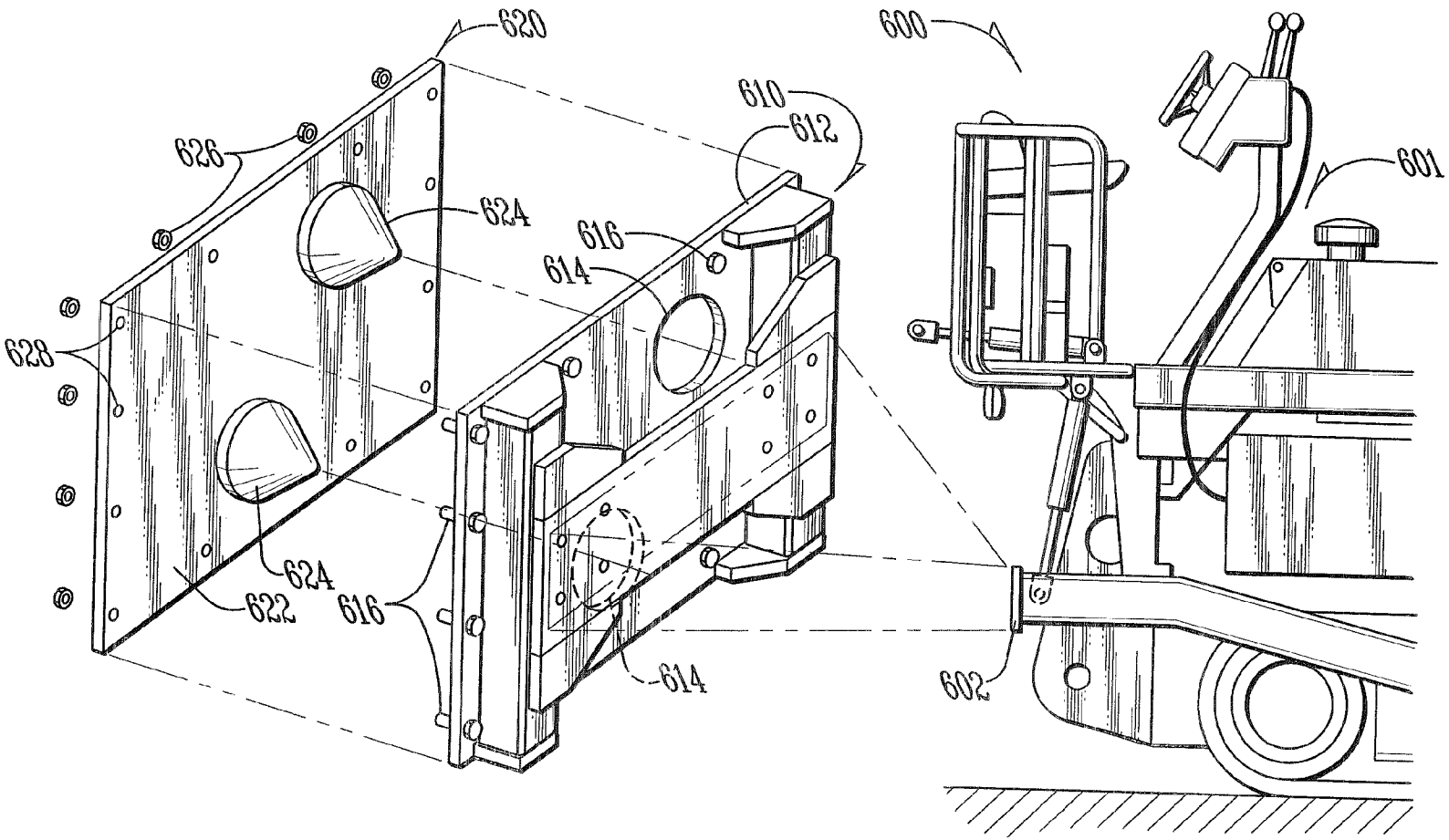
FIG. 6 is a perspective view of an exploded view of a multi-use paving tractor with a frame raise capability in combination with mounting plates for tool attachments.
Figure 1:
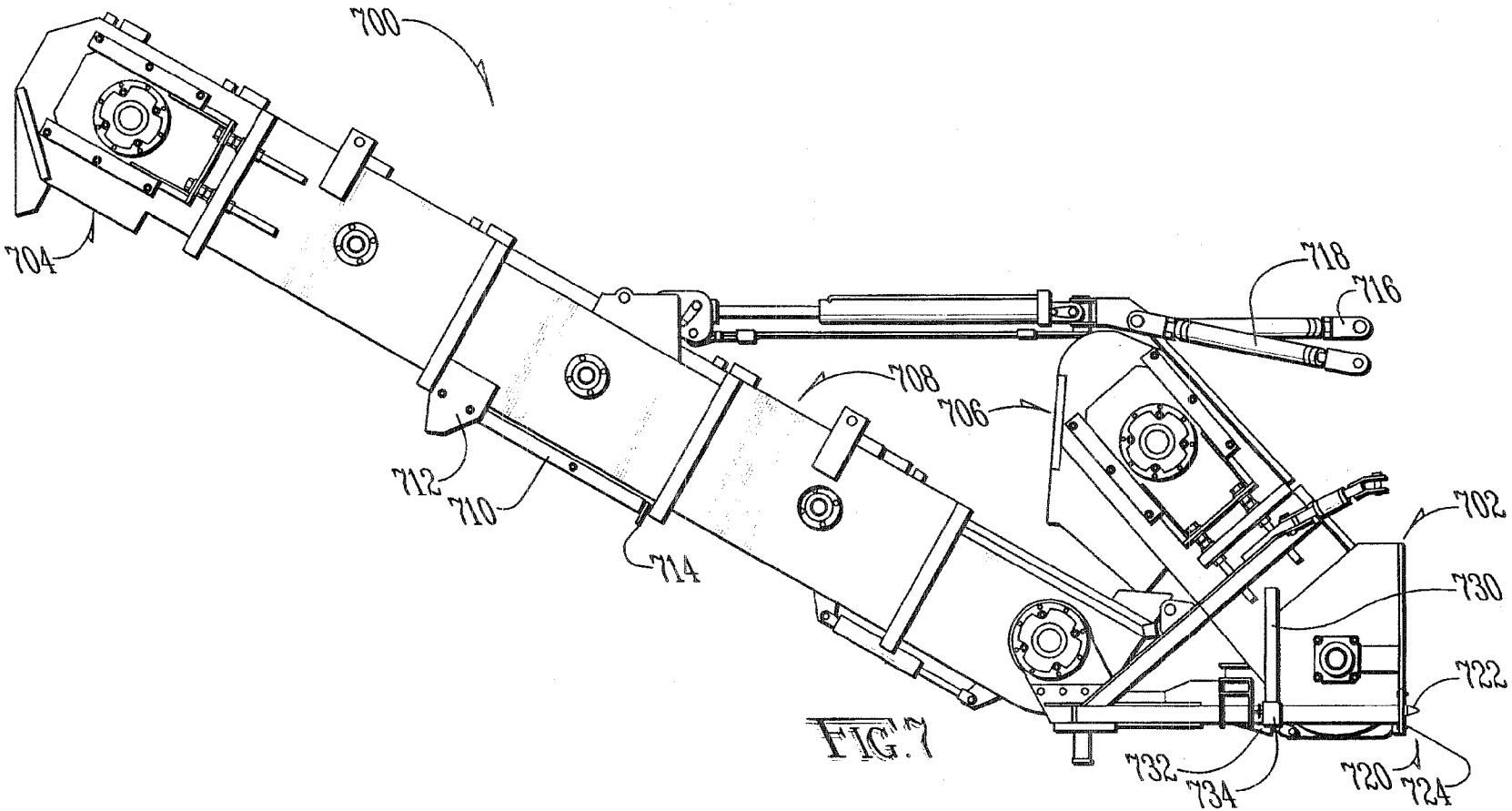

Now referring to FIG. 6, there is shown a system of the present invention, generally designated 600, which includes a paving tractor much like that shown in FIG. 1 except that an additional mechanism for adjusting the point of attachment to the tool attachments is included. The pull arm 103 of FIGS. 1-5 is augmented with a frame raise capability.

The term "frame raise capability" is a name given to the well-known capability to raise the rear of a paver as is found in Cedarapids, Inc. products. The raising may be a combined vertical and horizontal displacement as when pivoting along an arc or primarily a vertical translation of the paving tractor.

Pull arm 103 contemplates an adjustment of location of connection to the tool attachment by one or more hydraulic arms. The frame raise capability, which is not shown or discussed in detail, but well understood in the industry, involves lifting, raising or pivoting the entire rear end of the chassis and superstructure of a paver or in this case, a multi-purpose tractor, with respect to the ground or some forward located pivot point. System 600 includes the tractor 601, with the frame raise capability, as well as a structural support 602, which is attached to the multi-use tractor 601 and is raised when the frame raise mechanism is operated. Structural support 602 is preferably permanently attached to the tractor 601, but other non-permanent attachment arrangements could be used as well. Structural support 602 has voids therein for receiving self-centering cones therein. The structural support 602 may be permanently attached to the tractor mount system 610, including a sturdy tractor mounting plate 612 which has cone-receiving holes 614 therein for receiving therethrough the self-centering cones 624. Holes 614 may be made to have a diameter to match a diameter of self-centering cones 624. Tractor mounting plate 612 may have mounting bolts 616 extending therethrough for mating with mounting nuts 628 on the back side of tool mounting plate 622. Tool mounting plate 622 has self-centering cones 624 mounted thereon. Numerous other suitable quick connecting and/or blind mateable connection points and connection schemes could be substituted, so long as they facilitate quickly connecting attachments to a paving tractor having frame raise capabilities. The blind-mateable connection as shown in FIG. 6 is intended to be representative, in general, of the concept. However, in particular paving equipment attachments, the point of attachment of the blind-mateable connection will vary, and consequently the size, location, and other details are expected to differ.

The term "blind mateable" is used herein to describe a capability for mating two structural components without requiring an exact alignment being made by an operator or other person assisting in the mating. "Blind mateable" suggests that once the two structural members are brought into a crude alignment, they can be brought into minute alignment without more precise alignment maneuvers or adjustments occurring.

Structural support 602 and tractor mounting plate 612 may either singly or in combination form a connection point which is rigidly attached to the rear end of the paving tractor 601.

The system 600 could operate as follows: The tractor 601 with structural support 602 and tractor mounting plate 612 attached thereto, could be steered to back up to a tool attachment. The frame raise capability of the tractor 601 could be used to generally match the height of the tractor mounting plate 612 to the tool mounting system 620 with tool mounting plate 622; the self-centering cones 624 would enter the holes 614 at any location within the hole, including locations off center. This would be considered a crude alignment done by the operator. As the tractor backs up farther, the tool and/or paving tractor will automatically experience slight relative motion to better align the holes 614 with the self-centering cones 624. By the time the shorter bolts reach the tool mounting plate, they are made to be registered with the holes therein where tool mounting bolts 626 can be mounted thereon. This would be considered minute alignment. This process of blind mating the attachment to the tractor facilitates quick and relatively easy alignment and, therefore, attachment of tool attachments to the tractor 601.

Now referring to FIG. 7, there is an alternate HMA transfer tool attachment which is configured to be readily connected to or disconnected from a paving tractor 601. HMA transfer tool attachment, generally designated 700, includes an HMA input opening 702 and an HMA output opening 704. A first elevator section 706 delivers HMA to a second elevator section 708.

When attachment 700 is detached from paving tractor 601, it requires support to remain in the desired attach and detach orientation.

A second elevator support member 710 is shown disposed below the second elevator 708 and pivotal around a support pivot point 712. Support member 710 is preferably extendable by removing a retractable support portion 714, shown in the fully retracted and stowed position. When deployed, the retractable support portion 714 extends to the ground and is adjustable in length by insertion of a pin into one of a plurality of variable positioned adjustment holes (not shown). In alternate embodiments, other structures could be used, such as a hydraulic cylinder or a suitable substitute.

Upper connection members 718 are coupled to a portion of a paving tractor 601 via connectors 716. In one embodiment, the length of the connection members 718 can be adjusted by turning the connectors 716 which are coupled to the connection members via threaded connections. In alternate embodiments, a hydraulic cylinder could be used or a suitable substitute.

The attachment 700 is also coupled to the paving tractor 601 via blind mateable connector 720 which includes a centering cone 722 and a plurality of connection bolts 724.

The attachment 700 is stabilized with a front support member 730 having a retractable stand 732 (shown in the fully retracted and stowed position) which is held in place via a pin 734. A hydraulic cylinder or a suitable substitute could be used if desired.

In operation, the apparatus and method of the present invention as described in FIGS. 1-7, could function as follows:

Firstly, a multi-use paving tractor 601 is provided which accepts HMA in a hopper and mixing apparatus and transports it rearward via conveying shaft.

One of several attachments, such as HMA mix transfer tool attachment 700, right- or left-sided road widener attachment 300 or paver screed 518 could be attached to the multi-use paving tractor 601, depending upon the needs at the time. The combination is then deployed and used on a road. The attachment then is removed and replaced with another of the several attachments, and the new combination is used. Numerous road-paving tools can be deployed on one job without the need for redundant components.

The HMA transfer tool attachment could be detached from the paving tractor 601 as follows:

The paving tractor 601, which has a frame raise capability, has the frame raise in a center position. The attachment 700 is lowered hydraulically to a low position slightly above a point of contact with the ground. The support members 710 and 730 are deployed by lowering the retracted members 714 and 732 respectively. Pins are placed therein so as to minimize their distances from the ground.

The frame raise feature is lowered so as to allow the attachment 700 to rest on the ground.

The connectors 716 are disconnected from the paving tractor 601. All hydraulic and electrical connections are disconnected.

The bolts 724 are removed and the tractor 601 pulls away from the attachment 700.

The process is reversed to couple the attachment 700 to the paving tractor 601.

A screed could be attached in a similar manner. In an alternate embodiment, a screed could be blind-mateably coupled to a spreading screw section which is itself blind mateable with a tractor 601. Details of such a multi-stage modular attachment scheme is described in the above-referenced patent application entitled "Multi-stage modular road paving equipment and method of manufacture and sales," application No. 60/743,657 filed on Mar. 22, 2006.

Throughout the above description, HMA is described as the material to be used. It should be understood that the present invention is directed to any type of road surface. It is believed that recycled asphalt products could be used, cold mix asphalt, and even in certain applications with any appropriate modifications, concrete could be the paving material. Hopper and mixing apparatus 101 may comprise a rectangular box or an angled rectangular or circular bin or any shaped container and material mixing and transfer apparatus which is suitable for the paving material being used.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

We claim:

1. A method of deploying multi-use road paving equipment comprising the steps of:

providing a paving tractor with a first detachable road paving tool attachment operatively coupled thereto at a first connection point, where said first connection point is on a vertically adjustable pull arm; replacing said first detachable road paving tool attachment with a second detachable road paving tool attachment without welding or cutting metal at said first connection point;

where said first connection point is at an adjustable rear location on said paving tractor, where adjustment of the adjustable rear location is accomplished by manipulating a frame raise capability of the paving tractor;

where said first detachable road paving tool attachment is configured to perform a substantially different task than said second detachable road paving tool attachment;

wherein at least one of said first detachable road paving tool attachment and said second detachable road paving tool attachment comprises a means for elevating paving material away from a road surface while simultaneously minimizing any changes to the road surface as a result thereof; and wherein said paving tractor is a self-propelled vehicle configured to be driven by a driver located on and at a rear end of said paving tractor, said paving tractor further comprising a hopper disposed forward of said rear end, and means for conveying paving material from said hopper to said rear end.

2. A method of claim 1 wherein said step of replacing comprises the steps of:

causing said first detachable road paving tool attachment, while coupled to said paving tractor, to be disposed over a structural member disposed higher than a tractor operating surface upon which said paving tractor is disposed;

causing a vertical separation between said structural member and said first detachable road paving tool attachment to decrease; and separating said first detachable road paving tool from said paving tractor.

3. A method of claim 2 wherein said step of causing a vertical separation is accomplished by a manipulation of said vertically adjustable pull arm.

4. A method of claim 3 where said step of replacing further comprises the steps of:

mating said second detachable road paving tool attachment to said vertically adjustable pull arm; and using a lifting force assisted by an engine onboard said road paving tractor to lift said second detachable road paving tool attachment.

5. A paving tractor, wherein said paving tractor is a self-propelled vehicle configured to be driven by a driver located on and at a rear end of said paving tractor, said paving tractor comprising a hopper disposed forward of said rear end, and means for conveying paving material from said hopper to said rear end;

said paving tractor comprising a vertically adjustable pull arm, with a first connection point where said first connection point is at an adjustable rear location on said paving tractor, where adjustment of the adjustable rear location is accomplished by manipulating a frame raise capability of paving tractor;

said first connection point is configured to have a detachable road paving tool attachment attached and detached from it without welding or cutting metal at said first connection point; and wherein said detachable road paving tool attachment comprises a means for elevating the paving material away from a road surface while minimizing any resulting changes to the road surface.

* * * * *